US012110745B1

(12) United States Patent
Dickey

(10) Patent No.: US 12,110,745 B1
(45) Date of Patent: Oct. 8, 2024

(54) OILFIELD DRILL BIT JET NOZZLE WITH SLIT CONNECTING TWO ORIFICES

(71) Applicant: Winton B. Dickey, Manvel, TX (US)

(72) Inventor: Winton B. Dickey, Manvel, TX (US)

( * ) Notice: Subject to any disclaimer, the term of this patent is extended or adjusted under 35 U.S.C. 154(b) by 0 days.

(21) Appl. No.: 18/747,032

(22) Filed: Jun. 18, 2024

Related U.S. Application Data

(60) Provisional application No. 63/514,508, filed on Jul. 19, 2023.

(51) Int. Cl.
*E21B 10/61* (2006.01)
*E21B 10/60* (2006.01)

(52) U.S. Cl.
CPC ..... *E21B 10/61* (2013.01); *E21B 10/602* (2013.01)

(58) Field of Classification Search
CPC ..... E21B 10/60; E21B 10/61
See application file for complete search history.

(56) References Cited

U.S. PATENT DOCUMENTS

| | | | | |
|---|---|---|---|---|
| 4,533,005 | A * | 8/1985 | Morris | E21B 10/61 239/600 |
| 4,852,668 | A * | 8/1989 | Dickinson, III | E21B 10/60 175/257 |
| 5,579,855 | A | 12/1996 | Dickey | |
| 6,082,473 | A | 7/2000 | Dickey | |
| 6,581,702 | B2 | 6/2003 | Dickey | |
| 7,481,284 | B2 * | 1/2009 | Wells | E21B 10/61 175/429 |
| 8,047,308 | B2 * | 11/2011 | Gutmark | E21B 10/61 175/340 |
| 9,631,855 | B2 * | 4/2017 | Dodson | F25C 3/04 |
| 2008/0121434 | A1 * | 5/2008 | Wells | E21B 10/61 175/393 |
| 2010/0288562 | A1 * | 11/2010 | Dove | B05B 1/341 123/299 |

* cited by examiner

*Primary Examiner* — Blake Michener
(74) *Attorney, Agent, or Firm* — Keeling Law, LLC; Kenneth A. Keeling; Mark S. Solomon

(57) ABSTRACT

A jet nozzle for oilfield drill bits which utilizes a novel orifice configuration to allow for smaller sizes without the risk of debris clogging typically associated with smaller sized jet nozzles. The nozzle's orifices are arranged such that the larger of the paired orifices facilitates the unplugging of the smaller orifice when it may become clogged with debris from the mud used in the drilling process. The nozzles may be utilized with existing drilling equipment and may further enable the realization of smaller jet nozzle sizes.

6 Claims, 7 Drawing Sheets

OILFIELD DRILL BIT JET NOZZLE WITH SLIT CONNECTING TWO ORIFICES

FIELD OF THE INVENTION

The present invention relates generally to the field of oil drill bit jet nozzles. More specifically, the invention is an innovation on existing polycrystalline diamond cutter (PDC) drill bit jet nozzles.

BACKGROUND OF THE INVENTION

Existing drill bit jet nozzles cannot use smaller orifice sizes, as they incur an elevated risk in becoming plugged with debris within the drilling mud that is being circulated through the bit and back up the annulus. Typically, any nozzle orifice smaller than the 10/32 size is deemed too small and will incur a risk of debris clogging the orifice during the drilling process. Most bits are fitted with a single round orifice that has very high velocity directed into one area, generally the middle or inner section of the cutting structure of a bit. Other nozzles, such as side port nozzles, have been used to distribute jet velocity to a larger area of the cutting structure. These nozzles require two separate orifices and a modification placing a notch in the bit body intersecting the nozzle boss to allow exit of fluid through the side port. Thus, there exists a need for an improved drill bit jet nozzle capable of implementing a nozzle of smaller size while still avoiding the increased risk of becoming clogged with debris. Typical drill bits with a single orifice have a very high side splash of drilling fluid which hits the bottom of the hole, going 90-degrees and causing damage to both the cutter attach points and the trailing edge of the closest blade, which can erode the body of the bit in close proximity to where the nozzle velocity impacts the bottom of the hole.

The present invention aims to solve this problem by providing an improved design for a drill bit jet nozzle, having a slit connecting two orifices to allow for the use of a smaller nozzle without the same risk of plugging, resulting in a non-plugging drill bit jet nozzle having only a single contiguous orifice. To that end, the present invention is a drill bit jet nozzle with a slit connecting two orifices. The drill bit jet nozzle generally comprises a nozzle body, a small orifice, a large orifice, a connecting slit, a socket connection, and an indexable thread.

The small orifice and large orifice may be positioned on the nozzle body. The connecting slit may run between the small orifice and large orifice, connecting them and creating a single, contiguous opening in the nozzle body. In the ideal embodiment, the slanted large orifice may be directed towards the outer perimeter of the drill bit body, while the slanted small orifice is directed towards the inside of the drill bit body. There are several reasons for this configuration, the main ones being to spread high velocity drilling mud to more areas of the bit blade. When hydraulic horsepower per square inch is lower, standard jet nozzles cannot supply turbulence to all areas of the bit face (Only Random Flow). The indexable thread and socket connection permit the nozzle body to be screwed into the bit body and oriented in whatever direction is needed.

By slanting orifices, a larger area of the bit face will receive turbulence that removes cutting from the bit. Because of the velocity of the drilling mud through a nozzle any rock (or debris) lodged in the smaller opening will be cut away by the velocity in the slit that will also remain open due to it being connected to the larger opening. So, as long as the larger orifice is open it will keep the smaller orifice open due to their connection by the slit. This jet nozzle distributes the drilling fluid to a much larger area of the cutting structure which reduces the side splash damage.

DETAIL DESCRIPTIONS OF THE INVENTION

Figure 1:
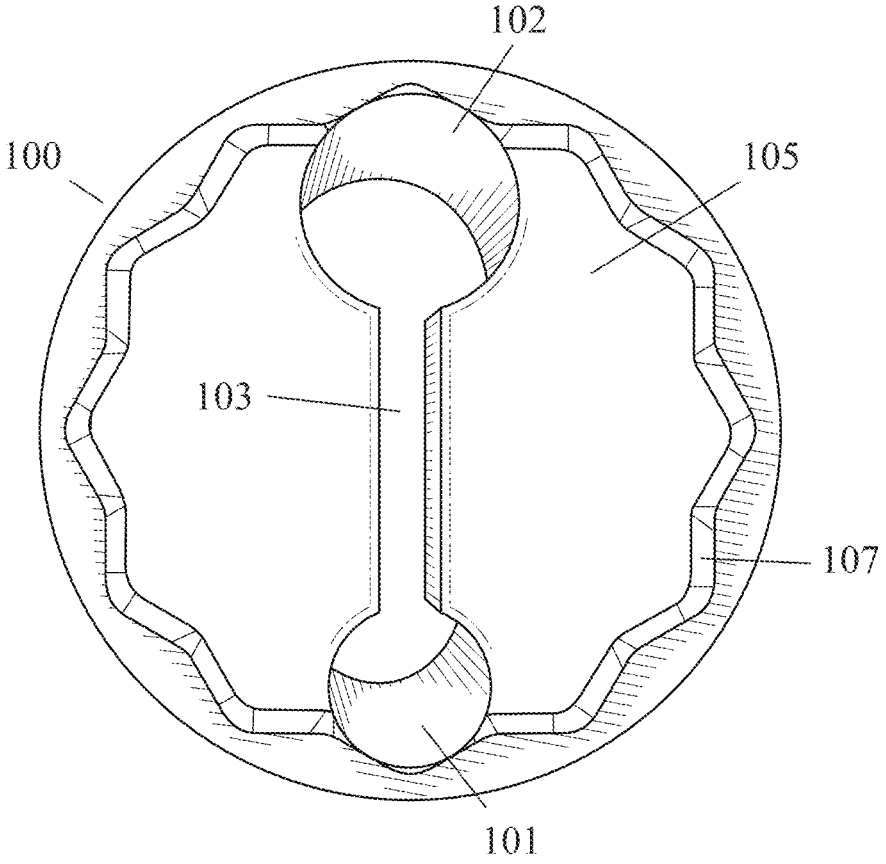
FIG. 1 is a tip-facing (anterior) view for an embodiment of the present invention.
Figure 2:
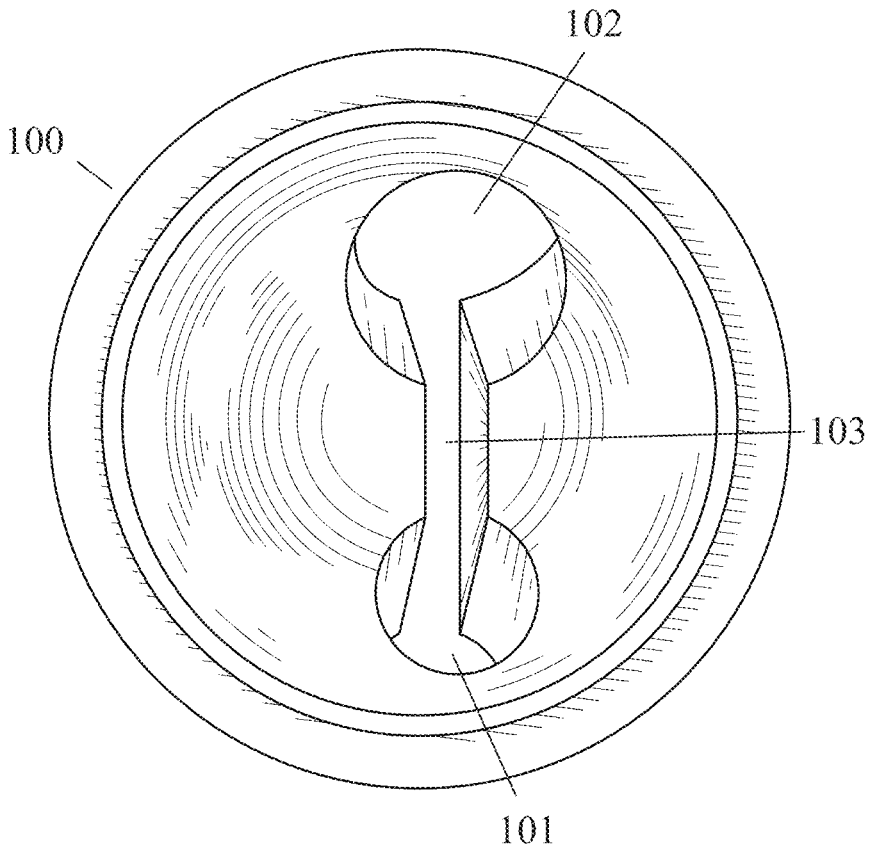
FIG. 2 is an under-side (posterior) view for an embodiment of the present invention.
Figure 3:
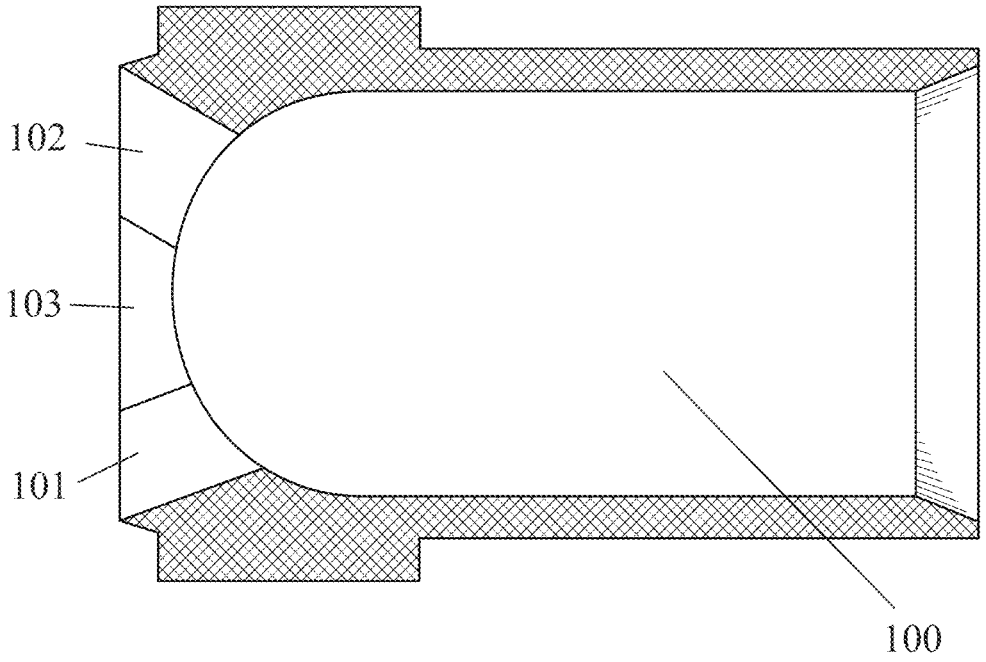
FIG. 3 is a side-facing cut-away view for an embodiment of the present invention, demonstrating the angled through-hole of the orifices at the end of the bit.
Figure 4:
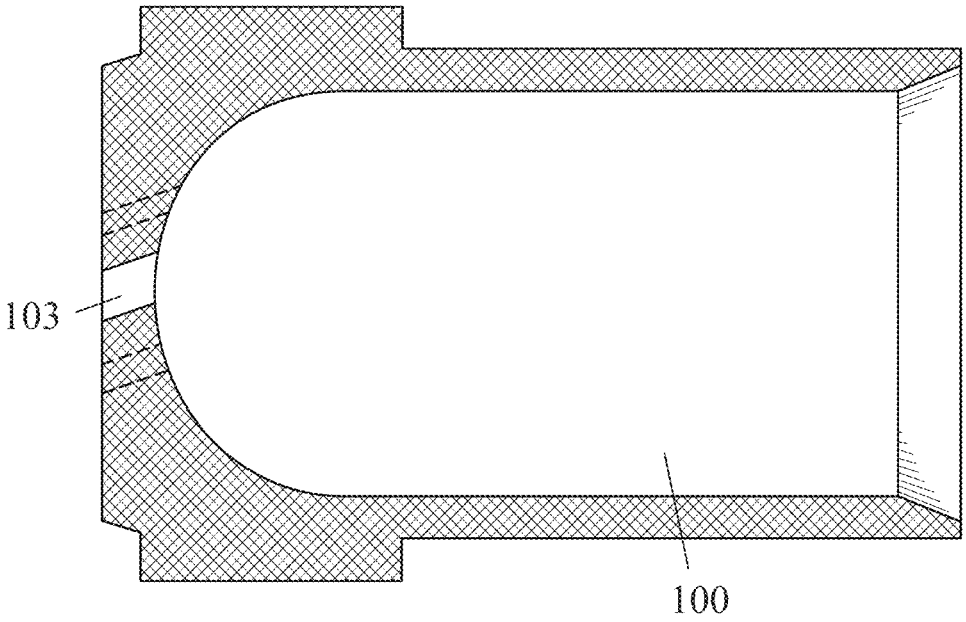
FIG. 4 is a side-facing cut-away view for an embodiment of the present invention, demonstrating the angled through-hole of slit at the end of the bit.

All illustrations of the drawings are for the purpose of describing selected versions of the present invention and are not intended to limit the scope of the present invention. Unless otherwise stated, any reference to language regarding what a component "is" should be read as meaning the component "may be" that particular thing, while still maintaining the possibility that the component may be substituted, repositioned, or otherwise interchanged with other similar components or arrangements of components that perform a similar function.

The present invention is a drill bit jet nozzle with a slit connecting two orifices. The drill bit jet nozzle generally comprises a nozzle body (100), a small orifice (101), a large orifice (102), a connecting slit (103), a socket connection (107), and an indexable thread (110).

The ideal embodiment for the nozzle body (100) is roughly cylindrical in shape. For this embodiment, the front of the nozzle body takes a convex form. Other shapes and configurations of the nozzle body may be contemplated. The socket connection (107) may be positioned perimetrically around the front edge of the drill body. The indexable thread (110) may be positioned on the side of the nozzle body. The indexable thread would generally be adapted for fastening to a drill bit, such as by screwing the drill bit jet nozzle into the drill bit, as is well-known in the art.

Likewise, the small orifice (101) would generally be positioned on the nozzle body (100) at its face (105). The small orifice (101) comprises a hole through the end of the bit and is of a smaller size than the large orifice (102). Ideally, the small orifice would be under 10/32 inches in size, or of any size that may otherwise be normally susceptible to becoming plugged-up with debris carried by the drilling mud. Other embodiments may include larges sizes while maintaining the spirit and scope of the present invention.

The large orifice (102) would then also be positioned on the nozzle body (100) at its face (105). The large orifice (102) comprises a through hole that is of a larger size than the small orifice (101). For the ideal embodiment, the large orifice (102) would be over 10/32 inches in size. However, smaller sizes are within the spirit and scope of the present invention, generally limited by sizes that are known to avoid becoming plugged with debris from the drilling mud.

The connecting slit (103) is an opening in the nozzle body (100) which connects the small (101) and large (102) orifices at either end of the slit (103). In this configuration, the small orifice and large orifice are connected by the connecting slit to form a single, contiguous opening in the nozzle body (100) on its face (105). This configuration prevents other issues that may be present with multiple orifice jet nozzles, while enabling the usage of a small orifice (101) below 10/32 inside while avoiding the typical issues with plugging of the small orifice (101) from debris. For example, whenever the small orifice (101) may become clogged, the drilling fluid flow from the large orifice (102) would be channeled through the connecting slit (103) and promptly clear the small orifice (101) of any blockage.

Figure 5:
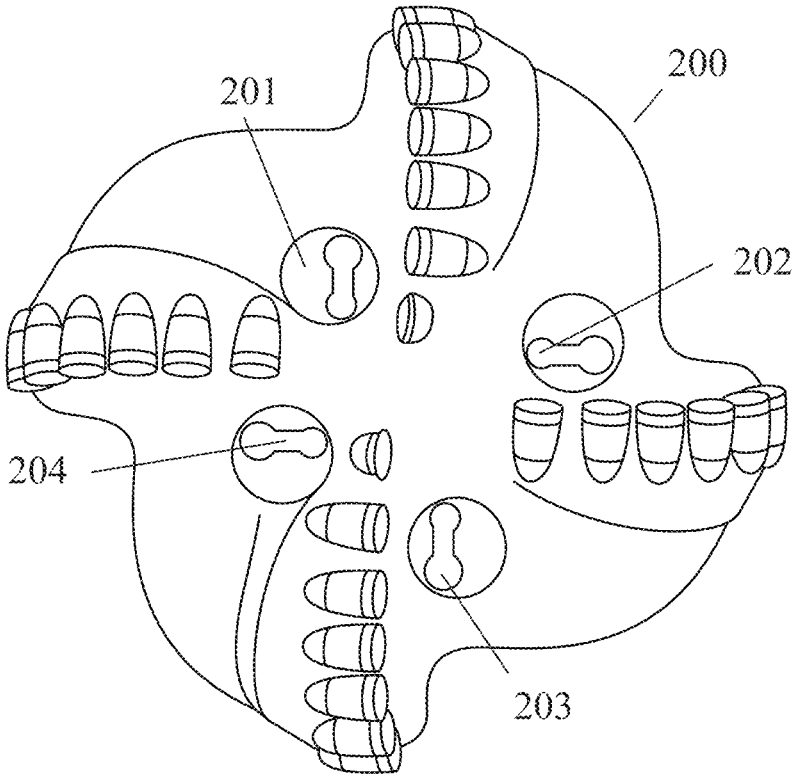
FIG. 5 is an anterior view of an exemplary drill bit, where an embodiment of the present invention has been installed at four (4) positions.
Figure 6:
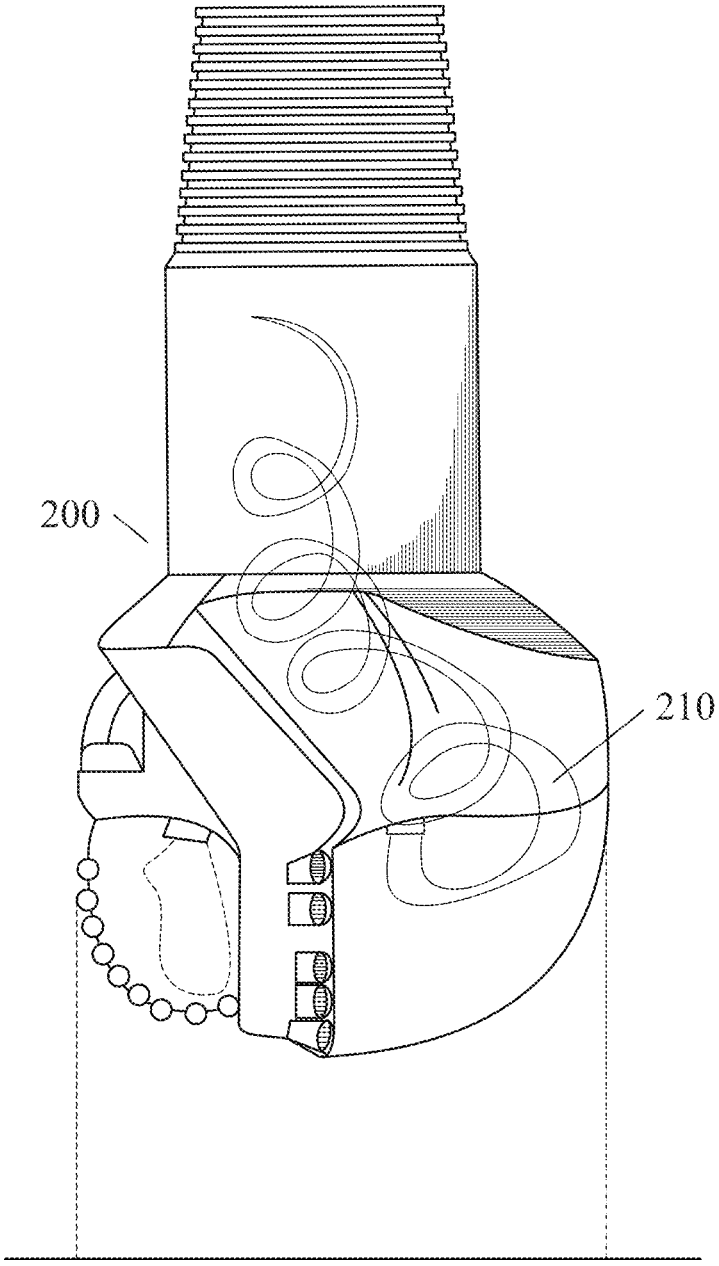
FIG. 6 is a side-facing view of an exemplary drill bit, demonstrating projected drilling fluid pathing which will enable coherent flow patterns.
Figure 7:
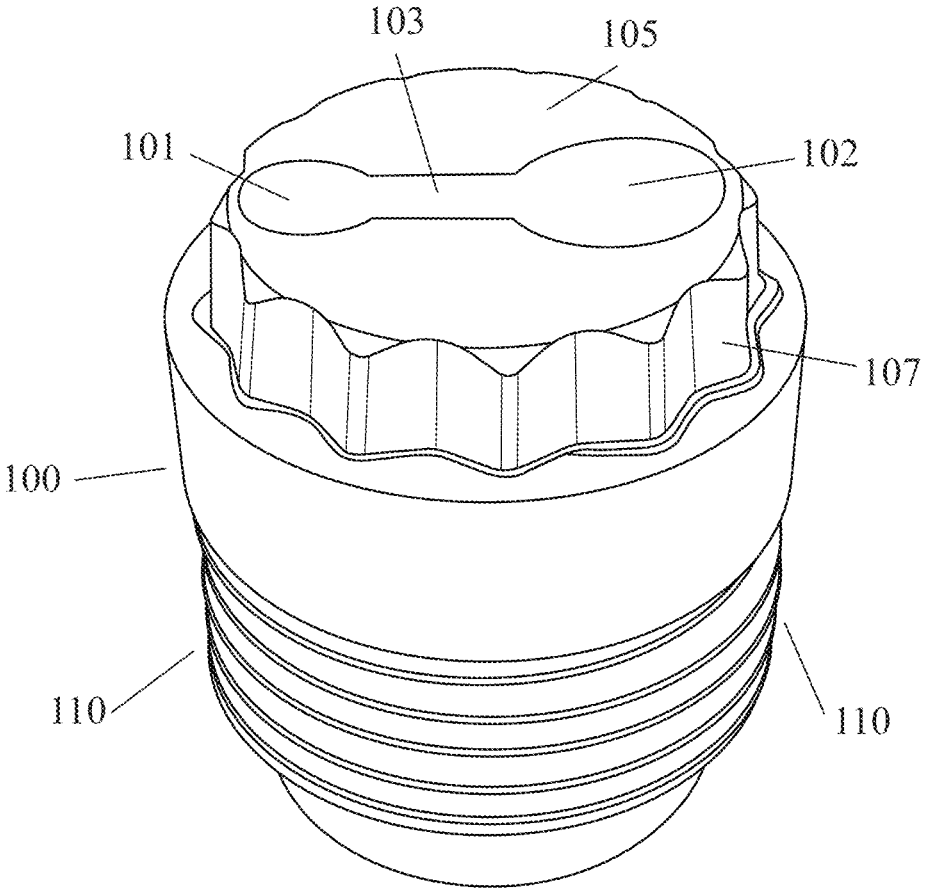
FIG. 7 is an overhead, off-set view for an embodiment of the present invention.

FIG. 5 and FIG. 6 demonstrate deployment of an exemplary embodiment for the present invention as a jet nozzle in a state of use, installed upon a drill bit. FIG. 5 shows a drill bit (200) where four instances of the present invention (201) have been installed upon it. As noted previously, the small orifice (202) is positioned closer to the center of the drill bit cutting structure (200), while the larger orifice (203) is positioned toward the outside of the drill bit cutting structure (200). Generally speaking, the center of a typical polycrystalline diamond compact (PDC) drill bit (200) is moving much slower than the outer section of the bit, hence inner cutters produce small amounts of cuttings, while the outer section produce many more cuttings, so the small orifice (201) opening will be slanted to the inner part of the bit and the large orifice (203) will be oriented or slanted to the outer section of the drill bit. In some embodiments, the larger orifice (203) may be directed outwards but may also have a slant towards the cutting blade, which will assist in removing cuttings faster. This configuration may also assist in cooling the PDC cutting elements, reducing wear caused by heat. This configuration furthers a coherent swirl (210) rather than random blow between bit blades, which will more efficiently carry drilling mud and debris away from the cutting structure. Because of the velocity of the drilling mud through a nozzle any rock (or debris) lodged in the smaller orifice (202) will be cut away by the velocity of the fluid in the connecting slit (204) that will also remain open due to it being connected to the larger orifice (203). Thus, as long as the larger orifice (203) is open it will keep the smaller orifice (202) open due to their connection by the slit (204).

For the ideal embodiment, all internal inlets will have square, sharp edges so that any debris trapped in smaller openings and the small orifice will be exposed to the highest velocity of drilling mud passing through an adjacent opening or orifice, causing debris to be eroded to a size that will allow it to pass through.

Although the invention has been explained in relation to its preferred embodiment, it is to be understood that many other possible modifications and variations can be made without departing from the spirit and scope of the invention.

The invention claimed is:

1. A drill bit jet nozzle apparatus comprising:
a nozzle body;
a small orifice;
a large orifice;
a connecting slit;
a socket connection; and
indexable threading;
wherein:
the nozzle body is generally cylindrical comprising:
a face at its anterior end,
a cavity formed through its interior, and
an opening at its posterior;
the socket connection is formed from the perimeter of the nozzle body's face;
the indexable threading is formed on the rounded sides of the nozzle body at its posterior;
the small orifice is a through hole on the nozzle body's face;
the large orifice is a through hole on the nozzle body's face;
the large orifice is larger than the small orifice;
the connecting slit is a through hole which connects the small orifice at one end and the large orifice at its opposite end; and
the inlet edges of the small orifice, large orifice, and connecting slit are each honed to a sharp edge on the internal surface of the nozzle.

2. The apparatus of claim 1, wherein the small and large orifices are angled toward the nearest outer edges of the nozzle body face.

3. The apparatus of claim 2, wherein the indexable threading is configured to position the device such that the small orifice is directed toward the inner part of the bit and the large orifice is directed toward the outer part of the bit.

4. The apparatus of claim 1, wherein the hole of the connecting slit is formed at an angle toward an outer edge other than the small or large orifices.

5. The apparatus of claim 1, wherein the diameter of the small orifice is no larger than 10/32 inches.

6. The apparatus of claim 1, wherein the diameter of the large 5 orifice is no smaller than 10/32 inches.

* * * * *